US008979145B2

(12) United States Patent
Yamagata

(10) Patent No.: US 8,979,145 B2
(45) Date of Patent: Mar. 17, 2015

(54) DOOR LOCK APPARATUS

(75) Inventor: Mikio Yamagata, Hiroshima (JP)

(73) Assignee: U-Shin Ltd., Tokyo (JP)

( * ) Notice: Subject to any disclaimer, the term of this patent is extended or adjusted under 35 U.S.C. 154(b) by 610 days.

(21) Appl. No.: 12/570,299

(22) Filed: Sep. 30, 2009

(65) Prior Publication Data

US 2010/0077806 A1 Apr. 1, 2010

(30) Foreign Application Priority Data

Oct. 1, 2008 (JP) ..... 2008-256387

(51) Int. Cl.

| | |
|---|---|
| ***E05C 3/06*** | (2006.01) |
| ***E05B 83/36*** | (2014.01) |
| *E05C 3/16* | (2006.01) |
| *E05B 77/32* | (2014.01) |

(52) U.S. Cl.

CPC ..... *E05B 83/36* (2013.01); *E05B 77/32* (2013.01); *Y10S 292/23* (2013.01)

USPC ..... 292/201; 292/216; 292/DIG. 23

(58) Field of Classification Search

USPC ..... 292/216, 201, DIG. 23

See application file for complete search history.

(56) References Cited

U.S. PATENT DOCUMENTS

| | | | | |
|---|---|---|---|---|
| 4,934,746 | A * | 6/1990 | Yamada | 292/201 |
| 4,948,183 | A * | 8/1990 | Yamada | 292/199 |
| 4,986,098 | A * | 1/1991 | Fisher | 70/262 |
| 5,715,713 | A * | 2/1998 | Aubry et al. | 70/277 |
| 5,803,515 | A * | 9/1998 | Arabia et al. | 292/216 |
| 5,975,596 | A * | 11/1999 | Rogers et al. | 292/216 |
| 6,148,651 | A * | 11/2000 | Roncin | 70/264 |
| 6,168,215 | B1 * | 1/2001 | Kodama et al. | 292/201 |
| 6,406,073 | B1 * | 6/2002 | Watanabe | 292/216 |
| 6,634,682 | B2 * | 10/2003 | Fukunaga et al. | 292/216 |
| 7,021,681 | B2 | 4/2006 | Hayakawa et al. | |
| 7,055,872 | B2 * | 6/2006 | Hayakawa et al. | 292/216 |
| 7,363,788 | B2 * | 4/2008 | Dimig et al. | 70/277 |
| 7,441,815 | B2 * | 10/2008 | Umino | 292/216 |
| 7,559,586 | B2 * | 7/2009 | Fukunaga et al. | 292/216 |
| 7,621,571 | B2 * | 11/2009 | Umino | 292/216 |
| 7,770,945 | B2 * | 8/2010 | Umino | 292/201 |

(Continued)

FOREIGN PATENT DOCUMENTS

| | | |
|---|---|---|
| JP | 2004-44360 | 2/2004 |
| JP | 2005-307573 | 11/2005 |

OTHER PUBLICATIONS

Chinese Office Action issued Jan. 25, 2013 in corresponding Chinese Application No. 200910178633.0.

*Primary Examiner* — Carlos Lugo
*Assistant Examiner* — Alyson M Merlino
(74) *Attorney, Agent, or Firm* — Wenderoth, Lind & Ponack, LLP

(57) ABSTRACT

A door lock apparatus includes with a latch mechanism (a fork and a claw) which engages with a striker so as to be capable of engaging and disengaging, a link which can move between an unlock position capable of engaging with an operation receiving portion of the latch mechanism and a lock position incapable of engaging therewith, a lock plate which moves the link, and open levers which interlock with a door handle provided inside a vehicle or outside the vehicle of a door, and cancel a lock of the striker by the latch mechanism via the link. The lock plate or the link is provided with an energizing member (a link energizing spring) which couples them so as to be relatively movable and energizes the link toward the unlock position with respect to the lock plate.

4 Claims, 7 Drawing Sheets

(56) References Cited

U.S. PATENT DOCUMENTS

| | | | | |
|---|---|---|---|---|
| 8,011,700 | B2 * | 9/2011 | Ishiguro | 292/216 |
| 8,303,004 | B2 * | 11/2012 | Lee et al. | 292/216 |
| 8,388,030 | B2 * | 3/2013 | Takahashi et al. | 292/201 |
| 2002/0050721 | A1 * | 5/2002 | Kobayashi et al. | 292/216 |
| 2004/0036298 | A1 | 2/2004 | Hayakawa et al. | |
| 2005/0140148 | A1 * | 6/2005 | Stoof et al. | 292/216 |
| 2005/0218662 | A1 * | 10/2005 | Umino | 292/216 |
| 2006/0186676 | A1 * | 8/2006 | Fukunaga et al. | 292/216 |
| 2009/0241617 | A1 * | 10/2009 | Takahashi et al. | 70/257 |

* cited by examiner (A)

(B)

DOOR LOCK APPARATUS

BACKGROUND OF THE INVENTION

1. Field of the Invention

The present invention relates to a door lock apparatus installed to a door of a vehicle.

2. Description of the Related Art

This kind of door lock apparatus is provided with a latch mechanism having a fork holding a striker provided in a vehicle body side, and a claw engaging with the fork so as to hold an engaged state of the striker by the fork. Further, the door lock apparatus is provided with a link which is set to be movable from an unlock position capable of engaging with the claw to a lock position incapable of engaging with the claw. If a lock plate is actuated by an operation of a key inserted to a cylinder key and a driving of an actuator by a remote control operation, the link is moved to the lock position and the unlock position by the lock plate.

Further, in a case where the door is opened, a door handle inside the vehicle or outside the vehicle is operated in a state where the link is moved from the lock position to the unlock position via the lock plate by the key operation or the remote control operation. Accordingly, the link is activated to open by an open lever coupled to the door handle to actuate the claw, thereby cancelling the engagement between the claw and the fork and canceling the held state of the striker by the fork.

However, in this door lock apparatus, since the link comes into contact with a side surface of an operation receiving portion of the claw in a case where the door handle has been already operated at a time of carrying out the lock cancellation (the unlocking operation) by the key operation or the remote control operation, the link can not be moved to the unlock position. As a result, the lock plate can not move to the unlock position. In this case, hereinafter, this state is called "panic state". In this case, there is a problem that the door can not be opened until the unlocking operation is carried out again after the operation of the door handle is stopped temporarily, and the door handle is thereafter operated.

As a related art publication information of the door lock apparatus which is structured such as to dissolve the problem mentioned above, there exists a Japanese Unexamined Patent Publication No. 2004-44360.

A door lock apparatus in Japanese Unexamined Patent Publication No. 2004-44360 is structured such that a lock plate (a locking lever) is constructed by a main lever, and a sub lever arranged so as to be relatively movable with respect to the main lever. Further, a spring for moving to an initial energized position before a relative movement is arranged between the main lever and the sub lever.

In the door lock apparatus in Japanese Unexamined Patent Publication No. 2004-44360, if a door handle is operated in an unlock state, a link is actuated and the link comes into contact with a claw (a lift lever) so as to rotate the claw, thereby canceling a held state of a striker and making the door openable. Further, if the door handle is operated in a lock state, the link is actuated. However, since the link is rotated to a position at which it can not come into contact with the claw, the held state of the striker can be maintained.

On the other hand, in a case where the door handle is operated in the lock state and the unlocking operation is carried out, the link is further unlock activated in a state where the link is activated to be opened by the operation of the door handle, thereby coming into contact with the claw. However, since the lock plate is constructed by the main lever and the sub lever which are relatively movable, the main lever is rotated to a normal unlock position. On the other hand, since the link is inhibited from rotating, the sub lever can not be rotated to a normal unlock position, and is relatively moved with respect to the main lever against an energizing force of the spring. Further, if the operation of the door handle is cancelled, the door opening actuation with respect to the link is cancelled. Accordingly, the link is moved to a non-open actuation position. At this time, the sub lever is moved to the initial energized position before the relative movement by the energizing force of the spring. As a result, the link is securely moved to the non-open actuation position and the unlock position.

As mentioned above, Japanese Unexamined Patent Publication No. 2004-44360 is structured such that the unlock state can be securely set by canceling the operation of the door handle, even if the unlocking actuation is carried out by the key operation or the remote control operation in a state where the door handle is operated in the lock state (an anti-panic mechanism).

However, in the door lock apparatus of Japanese Unexamined Patent Publication No. 2004-44360, since the lock plate is constructed by a pair of main lever and sub lever, and the spring is arranged for energizing them to the initial energized positions before the relative movement, there is a disadvantage that the parts number is increased, and a manufacturing cost becomes high.

SUMMARY OF THE INVENTION

The present invention is made by taking the conventional problem into consideration, and an object of the present invention is to provide a door lock apparatus which can suppress an increase of parts to a minimum, and can avoid a panic state by a simple structure.

In order to solve the above problems, a door lock apparatus of the present invention includes: a latch mechanism engaging with a striker provided in a vehicle body so as to freely engage and disengage, and having an operation receiving portion for canceling the engaging state; a link being movable between an unlock position capable of engaging with the operation receiving portion of the latch mechanism, and a lock position incapable of engaging with the operation receiving portion; a lock plate moving the link to the unlock position and the lock position; and an open lever interlocking with a door handle provided inside a vehicle or outside the vehicle of a door, engaging with the link so as to activate the link, and structured such that the link engages with the operation receiving portion of the latch mechanism so as to cancel the lock of the striker at a time when the link is at the unlock position, and the link can not engage with the operation receiving portion of the latch mechanism so as to maintain the lock of the striker at a time when the link is at the lock position, wherein the lock plate or the like is provided with an energizing member coupling the lock plate and the link so as to be relatively movable in a direction to the unlock position and the lock position, and energizing the link with respect to the lock plate toward the unlock position.

In this door lock apparatus, since the link can not engage with the operation receiving portion of the latch mechanism in a case where the link is activated to open the door via the open lever in a state where the link is moved to the lock position via the lock plate, the door can not be opened. Further, if the unlock operation is carried out in the operated state of the open lever, and the link is moved to the unlock position via the lock plate, the link comes into contact with the operation receiving portion similar to the related art.

However, in the present invention, since the lock plate and the link are held so as to be relatively movable by the energizing member, the lock plate can be moved to the unlock position by elastically contracting the energizing member in a case where the link comes into contact with the operation receiving portion. Further, if the opening operation of the door is canceled in this state, the link is returned to the non-open actuation position before the door opening actuation via the open lever. Accordingly, the link is moved to the unlock position by the energizing force of the energizing member. As a result, the door can be opened by operating the door handle to open without carrying out the unlocking operation again.

As mentioned above, the door lock apparatus in accordance with the present invention can construct the anti-panic mechanism only by being engaged and attached in the state where the link is energized toward the unlock position with respect to the lock plate by the energizing member. In other words, since the anti-panic mechanism can be constructed by the simple structure in which the energizing member is additionally arranged, without necessity of divisionally constructing the lock plate, it is possible to suppress an increase of the manufacturing cost.

In the door lock apparatus, it is preferable that the energizing member is arranged in the lock plate, and the link and the energizing member are coupled by a slide groove provided in the link in such a manner as to extend along a door opening actuation direction by the open lever, and a coupling portion provided in the energizing member in such a manner as to be inserted to the slide groove. In accordance with this structure, the coupling mechanism can be constructed by the simple structure.

Further, it is preferable that the lock plate is provided with a stopper portion regulating the link to an initial energized position in the unlock position side. In accordance with this structure, it is possible to prevent the displacement of the link, and it is possible to securely hold the link at the initial position.

Further, it is preferable that the energizing member is provided with an arm portion protruding from an annular winding portion, and is provided with the coupling portion in a leading end of the arm portion, and wherein the lock plate is provided with a regulating portion in which the arm portion of the energizing member is inserted movably in the direction to the unlock position and the lock position, and which regulates a movement toward the link. In accordance with this structure, it is possible to securely guide the movement (the displacement) of the energizing member by the regulating portion. Further, even if the link is activated via the open lever by the operation of the door handle, it is possible to prevent the link from interfering with the energizing member by the regulating portion. Accordingly, it is possible to securely prevent a malfunction of the link.

Further, it is preferable that the lock plate is provided with an attaching portion outwardly fitting and holding the winding portion of the energizing member, and the attaching portion is provided with a retention portion preventing the winding portion of the energizing member from coming off. In accordance with this structure, it is possible to maintain the assembled state without falling away the energizing member from the lock plate, and it is possible to improve an assembling workability of the door lock apparatus.

In the door lock apparatus in accordance with the present invention, the lock plate and the link can be engaged and attached so as to be relatively movable only by additionally arranging the energizing member in the lock plate or the link, thereby constructing the anti-panic mechanism. Accordingly, it is possible to suppress an increase of the parts number, and it is possible to suppress an increase of the manufacturing cost.

BRIEF DESCRIPTION OF THE DRAWINGS

FIGS. 2A and 2B show a latch mechanism of the door lock apparatus, in which FIG. 2A is a side elevational view showing a door open state, and FIG. 2B is a side elevational view showing a door close state;

FIGS. 6A and 6B show the lock plate and a link energizing spring, in which FIG. 6A is a front elevational view and FIG. 6B is a cross sectional view of a substantial part;

DETAILED DESCRIPTION OF THE INVENTION

A description will be given below of an embodiment in accordance with the present invention with reference to the accompanying drawings.

Figure 1:
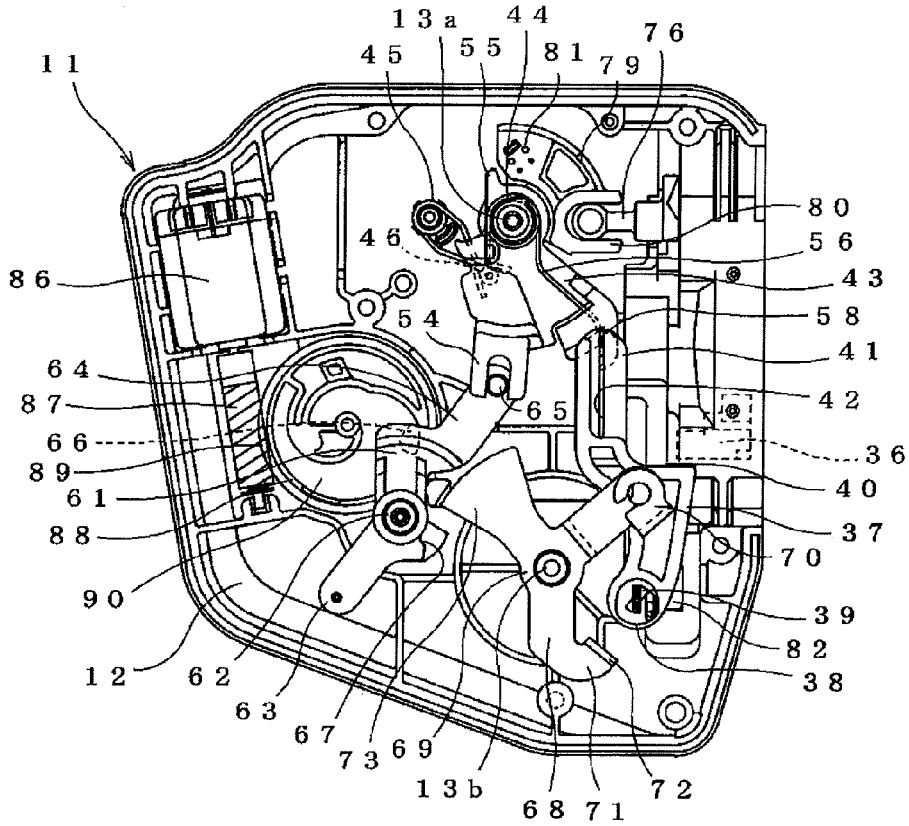
FIG. 1 is a front elevational view showing a lock mechanism of a door lock apparatus in accordance with a first embodiment of the present invention.
Figure 2:
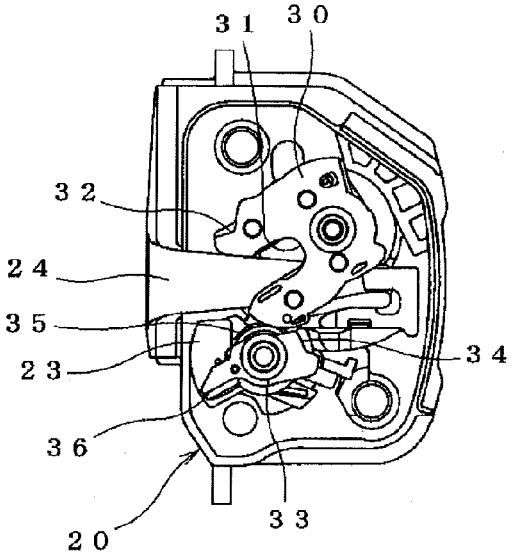
Figure 2:
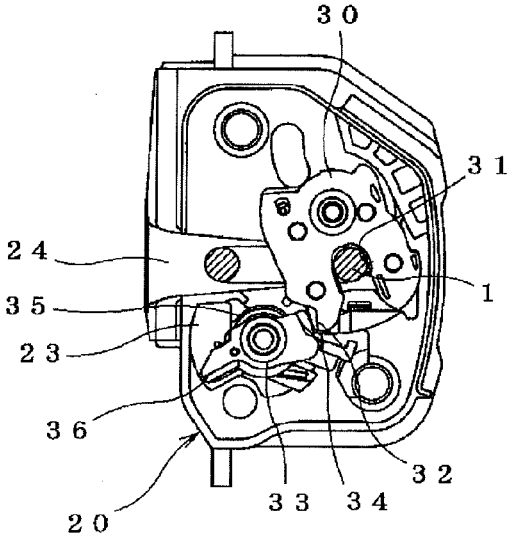
Figure 3:
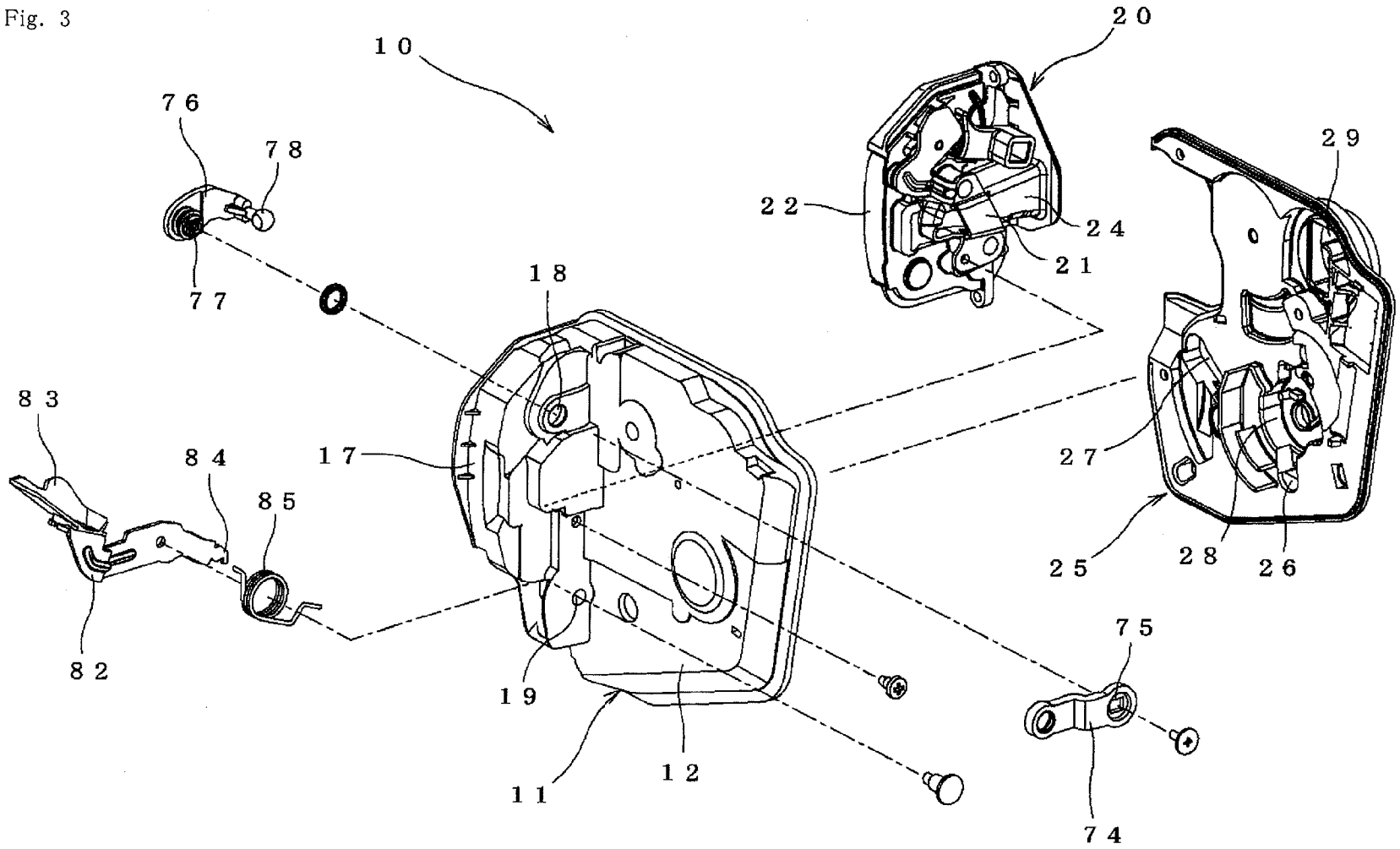
FIG. 3 is an exploded perspective view showing a construction of the door lock apparatus.

FIGS. 1 to 3 show a door lock apparatus in accordance with an embodiment of the present invention. The door lock apparatus is installed in an openable door of a vehicle, and engages with and disengages from a striker 1 arranged in a vehicle body. In the door lock apparatus, a latch mechanism engages with the striker 1, and a lock mechanism is capable of unlocking so as to cancel the engaging state of the striker 1 by the latch mechanism or locking so as to be incapable of canceling the enabling state are arranged in a casing 10.

The casing 10 is provided with a main case 11 arranging each of parts constructing the lock mechanism, a sub case 20 arranging each of parts constructing the latch mechanism, and a cover 25 covering a lock mechanism arranging surface in the main case 11.

Figure 4:
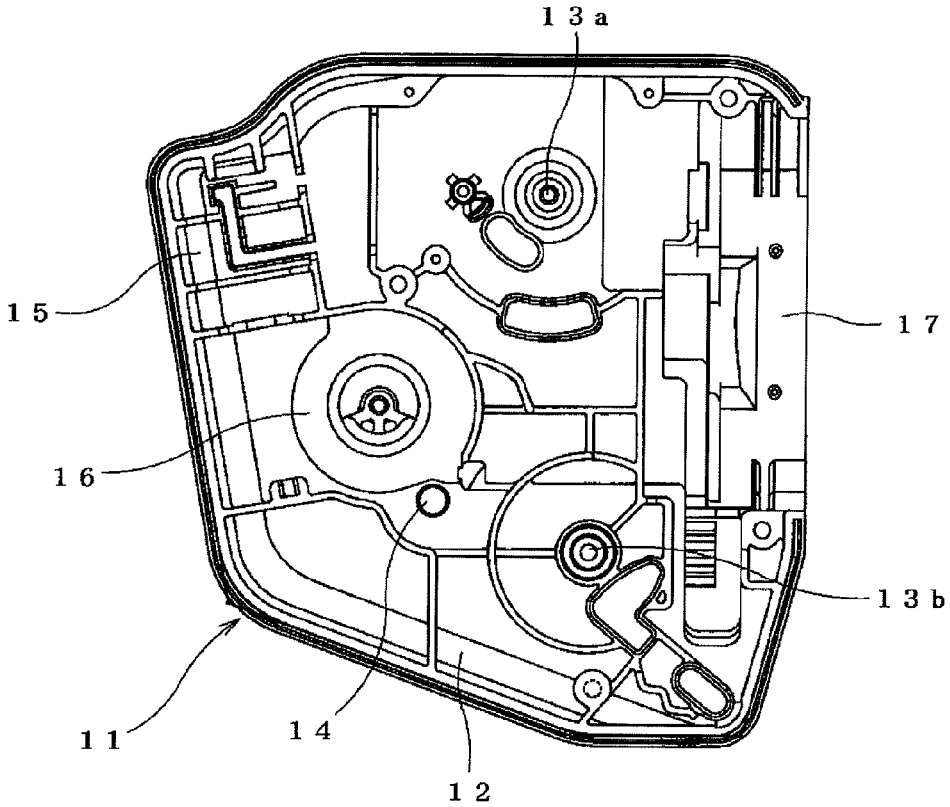
FIG. 4 is a front elevational view showing a lock mechanism arranged portion of a main case.

The main case 11 in accordance with the present embodiment has an L-shaped form in a plan view which is provided with a lock mechanism arranging portion 12 and a latch mechanism cover portion 17, as shown in FIG. 3. The lock mechanism arranging portion 12 is provided with attaching shaft portions 13*a* and 13*b* rotatably attaching a lock plate 43 and an inner open lever 68 mentioned below, as shown in FIGS. 1 and 4. Further, a shaft hole 14 for rotatably arranging a knob lever 61 is provided in a left side portion of the attaching shaft portion 13*b* of the inner open lever 68, in the drawing. A drive motor arranging portion 15 and a cam member arranging portion 16 are provided further in an upper left side of the shaft hole 14. The latch mechanism cover portion 17 covers an opening portion of the sub case 20 arranging the latch mechanism. As shown in FIG. 3, the latch mechanism cover portion 17 is provided with a first attaching hole portion 18 for rotatably installing a first key lever 74 and a key shaft 76. Further, there is provided a second attaching hole portion 19 for rotatably installing an outer open lever 82 by swaging a rivet or the like.

The sub case 20 is installed to the latch mechanism cover portion 17 of the main case 11, is provided with a metal reinforcing plate 21 in a surface opposed to the latch mechanism cover portion 17, and is provided with a surface plate 22 in a surface in an opposite side, as shown in FIGS. 2A and 2B and FIG. 3. The surface plate 22 is provided with an insertion groove (not shown) inserting the striker 1, and is provided with an attaching hole portion (not shown) for rotatably installing a fork 30 and a claw 33 constructing the latch mechanism by swaging. Further, the sub case 20 is provided with an insertion hole 23 through which an operation receiving portion 36 of the claw 33 passes so as to protrude into the lock mechanism arranging portion 12. Further, an insertion concave portion 24 concaved toward the latch mechanism cover portion 17 is provided at a corresponding position to the insertion groove of the surface plate 22.

The cover 25 is installed to the lock mechanism arranging portion 12 of the main case 11, and is provided with a first insertion portion 26 through which a lock knob connection portion 63 of a knob lever 61 passes so as to protrude to an outer side, and a second insertion portion 27 through which an inner door handle coupling portion 70 of an inner open lever 68 passes so as to protrude to an outer side, as shown in. FIG. 3. Further, the cover is provided with a concave portion 28 for securing a rotation region of the knob lever 61, and a connector connection port 29 through which a connector (not shown) for electrically connecting a signal line of a lock state or the like, a power line and the like passes.

Further, the latch mechanism in accordance with the present embodiment which is assembled in the sub case 20 is provided with the fork 30 engaging with and disengaging from the striker 1, and the claw 33 engaging with the fork 30 so as to maintain a state where the fork 30 holds the striker 1, as shown in FIGS. 2A and 2B.

The fork 30 has an approximately U-shaped form and is attached rotatably to the surface plate 22. An engaging groove 31 capable of inserting the striker 1 thereto is provided in the fork 30, and is energized to an open position corresponding to an illustrated state by a spring (not shown). Further, the fork 30 is provided with an engaging portion 32 in a leading end portion in a clockwise direction of open ends of the engaging groove 31.

The claw 33 is attached rotatably to the surface plate 22 in the same manner as the fork 30. The claw 33 is provided with an engagement receiving portion 34 with which the engaging portion 32 of the fork 30 engages, and is energized to an engaging position corresponding to an illustrated state by a spring 35. Further, the claw 33 is provided with an operation receiving portion 36 passing through the insertion hole 23 of the sub case 20 so as to be positioned within the lock mechanism arranging portion 12. The operation receiving portion 36 is provided in such a manner as to protrude to an opposite side with respect to the engagement receiving portion 34, and is structured such as to cancel the engaging state of the striker 1 by being pressed upward in the drawing by a link 37 mentioned below within the lock mechanism arranging portion 12.

If the striker 1 moves into the engaging groove 31 of the fork 30 by closing the door so that the striker 1 is pressed by a door closing actuation force, the latch mechanism is rotated in a counterclockwise direction in the drawing. Further, as shown in FIG. 2B, the engaging groove 31 is positioned so as to extend approximately in an orthogonal direction to the insertion concave portion 24, and the engaging portion 32 engages with the engagement receiving portion 34 of the claw 33 in this state, thereby maintaining the engaging state of the striker 1 by the fork 30. If the operation receiving portion 36 of the claw is activated upward in this state, the claw 33 is rotated in a clockwise direction, whereby the engagement between the engagement receiving portion 34 and the engaging portion 32 of the fork 30 is cancelled. As a result, the fork 30 is rotated to an open position shown in FIG. 2A by an energizing force of a spring (not shown), and cancels the engagement of the striker 1. Further, if the upward actuation force of the operation receiving portion 36 is canceled, the claw 33 is restored to the engaging position by the energizing force of the spring 35.

Further, the lock mechanism in accordance with the present embodiment which is assembled in the main case 11 is provided with a link 37 for activating the claw 33 in an engagement canceling direction, and a lock plate 43 for enabling or disenabling the actuation of the claw 33 by the link 37, as shown in FIG. 1. Further, a knob lever 61 activating to lock and unlock the link 37 via the lock plate 43 is arranged as an inner lock operation system, and an inner open lever 68 activating to open the latch mechanism via the link 37 is arranged as an inner door handle operation system. Further, first and second key levers 74, 79 and a key shaft 76 activating to lock and unlock the link 37 via the lock plate 43 are arranged as an outer lock operation system, and an outer open lever 82 activating to open the latch mechanism via the link 37 is arranged as an outer door handle operation system. Further, a drive motor 86 and a cam member 88 are arranged as a motor-driven lock operation system.

Figure 5:
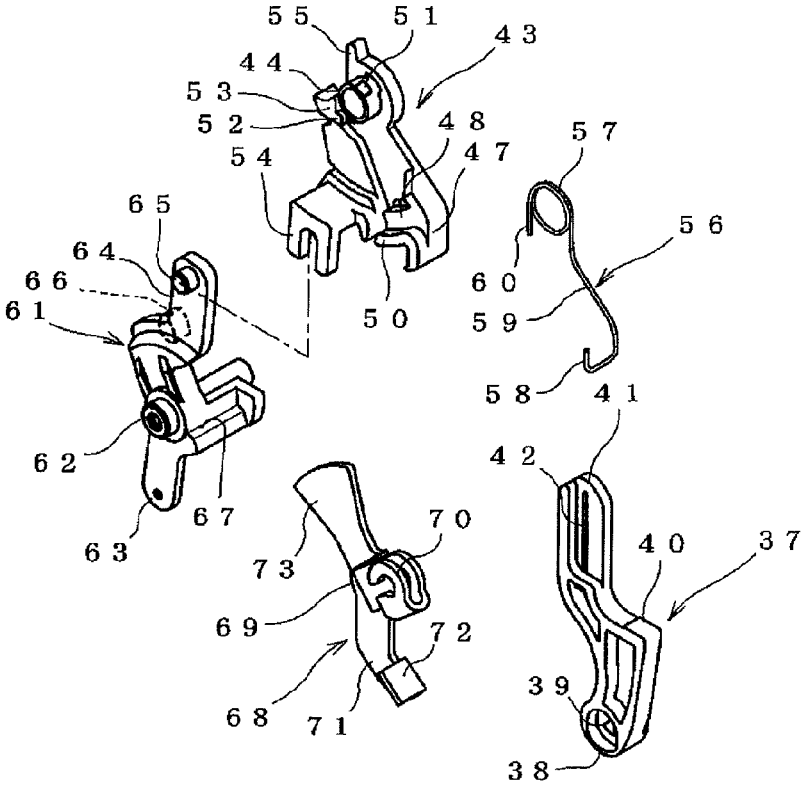
FIG. 5 is an exploded perspective view of a link, a lock plate, a knob lever and an inner open lever.

The link 37 is structured such as to be moved in an upward direction by receiving an actuation force of the inner open lever 68 or the outer open lever 82, as shown in FIGS. 1 and 5, thereby coming into contact with the operation receiving portion 36 of the claw 33 so as to rotate the claw 33, and canceling the engagement of the fork 30. The link 37 has a one end coupled to the lock plate 43 and the other end coupled to the outer open lever 82, and is moved (oscillated) between an unlock position capable of engaging with the operation receiving portion 36 of the claw 33 and a lock position incapable of engaging therewith, by the rotation of the lock plate 43. Specifically, the link 37 is provided with a receiving portion 38 receiving the rotation of the inner open lever 68 at a lower end. The receiving portion 38 is provided with a coupling hole 39, and is structured such as to be capable of receiving the rotation of the outer open lever 82 by the outer open lever 82 being coupled to the coupling hole 39. An upper portion of the receiving portion 38 is provided with an operation portion 40 coming into contact with the operation receiving portion 36 of the claw 33. Further, a lock plate coupling portion 41 is continuously provided beside the operation portion 40 in such a manner as to extend approximately as a J-shaped form. The lock plate coupling portion 41 is provided with a slide groove 42 in such a manner as to be movable relatively with respect to the lock plate 43 at a time of receiving the actuation force of the inner open lever 68 or the outer open lever 82 so as to slidably move upward. In other words, the lock plate coupling portion 41 and the slide groove 42 are provided in such a manner as to extend in a door opening actuation direction of the link 37.

On the lock plate 43 is arranged a link energizing spring 56 mentioned below so that the lock plate 43 is structured such as to engage with the link 37 via the link energizing spring 56, and move the link 37 to the unlock position and the lock position. Specifically, the lock plate 43 is provided with a tubular attaching portion 44 which is rotatably attached to the attaching shaft portion 13*a* of the main case 11, and is formed as an approximately fan shape having the attaching portion 44 as a top portion. The lock plate 43 is provided with a spring receiving portion 46 receiving an action spring 45 for positioning and holding a state at a time when it is moved to the lock position and the unlock position.

Figure 6:
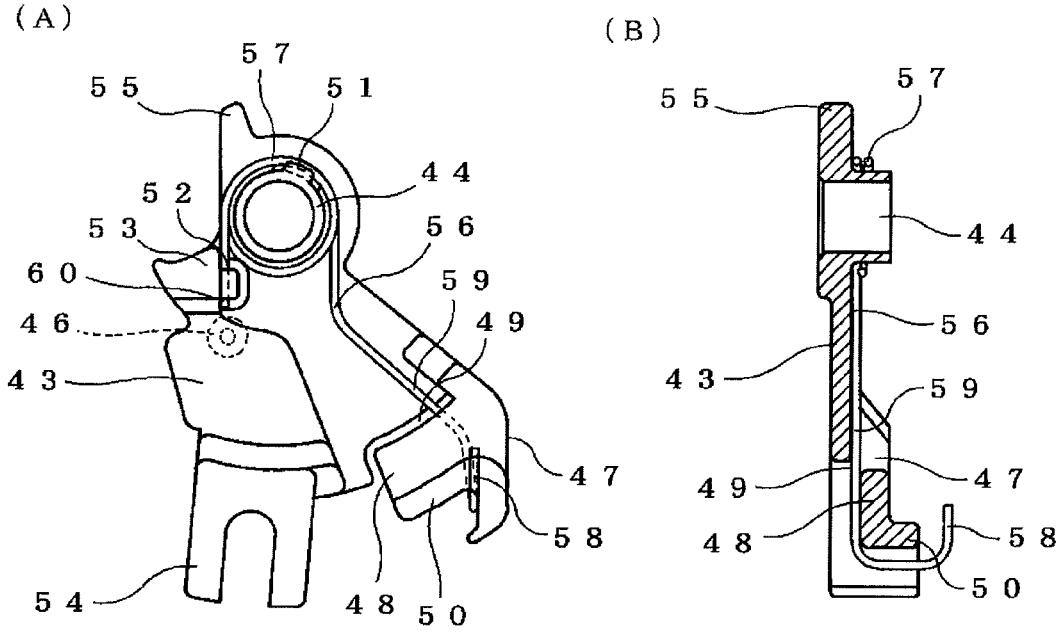

Further, the lock plate 43 is provided with a stopper portion 47 in a side in which the link 37 is arranged, as shown in FIG. 5 and FIGS. 6A and 6B. The stopper portion 47 comes into contact with a link energizing spring 56 so that the link 37 is regulated at an initial energized position in the unlock position side by the link energizing spring 56. The stopper portion 47 is constructed by a wall surface protruding from a side edge in the lock plate 43 formed as a circular arc shape to an upward direction corresponding to a side in which the link 37 is arranged. Further, the lock plate 43 is provided with a regulating portion 48 protruding from the stopper portion 47 toward a lock rotating side. The regulating portion 48 is structured so that an arm portion 59 of the link energizing spring 56 is inserted so as to be movable in a direction to the unlock position and the lock position, and regulate the movement toward the link 37. Accordingly, the regulating portion 48 is protruded from a protruding end of the stopper portion 47, and is structured such that an insertion portion 49 having a predetermined width is formed with respect to the lock plate 43. An upper surface of the regulating portion 48 is provided with a convex portion 50 protruding further upward, and the convex portion 50 prevents the link 37 arranged above from interfering with the link energizing spring 56.

Further, the lock plate 43 is provided with retention portions for preventing the link energizing spring 56 from coming off. The first retention portion is constructed by a retention pawl portion 51 provided in an outer peripheral portion of the attaching portion 44. Further, the second retention portion is constructed by the regulating portion 48 regulating one end of the link energizing spring 56. Further, the third retention portion is constructed by a spring engaging portion 52 engaging with the other end of the link energizing spring 56. The spring engaging portion 52 is constructed by a pawl protruding from a bulge portion 53 provided in the vicinity of the attaching portion 44 toward an unlock rotation side. Further, the bulge portion 53 serves as an engaging wall with which an end portion of the link energizing spring 56 engages so as to be positioned.

Further, the lock plate 43 is provided with a knob lever engaging and attaching portion 54 formed approximately as a U-shaped form, in a side in which a knob lever 61 is arranged in an inverse side to the stopper portion 47. Further, the attaching portion 44 is provided in a protruding manner with an unlock actuation receiving portion 55 receiving an unlock actuation by a second key lever 79. In this case, an edge in a side in which the stopper portion 47 is provided in the lock plate 43 constructs a lock actuation receiving portion receiving a lock actuation by the second key lever 79.

The link energizing spring 56 is arranged in the lock plate 43, and is an energizing member energizing the link 37 toward the unlock position with respect to the lock plate 43. The link energizing spring 56 is provided with a winding portion 57 which is wound so as to form an annular shape with an inner diameter outward fitting the attaching portion 44. A coupling portion 58 for coupling to the link 37 is provided in the link energizing spring 56 so as to protrude via the arm portion 59. In other words, one end of a wire rod protruding from the winding portion 57 extends on the lock plate 43, and is formed as the arm portion 59 extending to an outer end edge of the regulating portion 48 while passing through the insertion portion 49. Further, in a leading end of the arm portion 59, there is formed a coupling portion 58 which is curved so as to form an approximately horizontal U-shaped form, and is inserted to the slide groove 42 of the link 37 protruding from the convex portion 50 so as to be positioned in an upper portion. The arm portion 59 constructed as mentioned above is movable in the direction to the unlock position and the lock position, within the insertion portion 49, that is, in the lower portion of the regulating portion 48. Accordingly, the link 37 and the lock plate 43 which are engaged and attached by the link energizing spring 56 are coupled so as to be relatively movable in the direction to the unlock position and the lock position. Further, in the link energizing spring 56, the other end of the wire rod protruding from the winding portion 57 is formed as an engaging end portion 60 engaged with the spring engaging portion 52 of the lock plate 43. Note that the link energizing spring 56 in accordance with the present embodiment is structured such as to make the energizing force energizing the link 37 to the initial energizing position directed to the unlock position smaller than the energizing force holding the lock plate 43 at the unlock position by the action spring 45.

The knob lever 61 is coupled to a lock knob (not shown) provided inside the vehicle of the door by a wire or the like, and is engaged with the lock plate 43, as shown in FIGS. 1 and 5. Further, the knob lever 61 is structured such as to activate the lock plate 43 interlocking with the operation of the lock knob, and move the link 37 to the lock position or the unlock position. The knob lever 61 is provided with a rotation shaft portion 62 for attaching to the shaft hole 14 of the main case 11. Further, the knob lever 61 is provided with a lock knob connection portion 63 protruding in a diametrical direction from the rotation shaft portion 62 and protruded to an outer side of the casing 10 from the first insertion portion 26 of the cover 25. Further, the knob lever 61 is provided with a coupling arm portion 64 extending approximately as an L-shaped form toward the knob lever engaging and attaching portion 54 of the lock plate 43 so as to protrude from the rotation shaft portion 62, and a leading end of the coupling arm portion 64 is provided with an engaging protruding portion 65 inserted and engaged with the groove of the knob lever engaging and attaching portion 54. Further, the coupling arm portion 64 is provided with a cam receiving portion 66 engaging with a cam groove 90 of a cam member 88 positioned at a back portion in a protruding manner. Further, the knob lever 61 in accordance with the present embodiment is provided with an engagement receiving portion 67 receiving a rotating motion of the inner open lever 68 only in a state in which the knob lever 61 is moved to the lock position.

The inner open lever 68 is coupled to an inner door handle (not shown) provided inside the vehicle of the door, is engaged (brought into contact) with the receiving portion 38 of the link 37, and is structured such as to activate (slide) the link 37 toward the side of the operation receiving portion 36 of the claw 33. This inner open lever 68 is provided with an attaching portion 69 which is rotatably attached to the attaching shaft portion 13*b* of the main case 11. The inner open lever 68 is provided with an inner door handle coupling portion 70 extending so as to protrude from the second insertion portion 27 of the cover 25 to an outer side of the casing 10 and coupled to the inner door handle. Further, the inner open lever 68 is provided with an approximately J-shaped link actuation portion 71 in such a manner that the receiving portion 38 of the link 37 is positioned on a rotation locus around the attaching portion 69 in an assembled state. A leading end of the link actuation portion 71 is formed as a contact surface portion 72 which is bent for securing a sufficient contact area with respect to the receiving portion 38. Further, the inner open lever 68 is provided with an engagement portion 73 engaging with the engagement receiving portion 67 of the knob lever 61 so as to move the link 37 to the unlock position via the knob lever 61 and the lock plate 43, in a state in which the knob lever 61 is positioned at the lock position.

The first key lever 74 is coupled to a cylinder lock which is arranged in such a manner as to expose to a vehicle outer side of the door, and is rotatably attached together with the key shaft 76 to the first attaching hole portion 18 of the latch mechanism cover portion 17 of the main case 11, as shown in FIG. 3. The first key lever 74 is provided with a square shaped coupling hole 75 in such a manner as to disenable the relative rotation with respect to the key shaft 76.

The key shaft 76 is arranged in an inner portion side while holding a wall surface of the latch mechanism arranging portion therebetween with respect to the first key lever 74, and has an L-shaped form which is provided in one end with a first coupling portion 77 which is coupled to the coupling hole 75. A second coupling portion 78 which is coupled to a second key lever 79 is provided in the other end of the key shaft 76, and is structured such as to transmit a rotating force of the first key lever 74 to the second key lever 79 in which a rotating direction is an orthogonal direction.

The second key lever 79 is attached to the attaching shaft portion 13*a* attaching the lock plate 43, as shown in FIG. 1, and is provided with a coupled portion 80 coupling the second coupling portion 78 of the key shaft 76. The coupled portion 80 constructs a lock actuation portion which comes into contact with a side edge of the lock plate 43 and activates to lock the lock plate 43. Further, the second key lever 79 is provided with a contact point portion 81 for detecting a rotation position of the second key lever 79, and a lower portion thereof constructs an unlock actuation portion which comes into contact with the unlock actuation receiving portion 55 of the lock plate 43 and activates to unlock the lock plate 43.

The outer open lever 82 is arranged so as to pass through the lock mechanism arranging portion 12 inside and outside, and is rotatably attached to the second attaching hole portion 19 of the latch mechanism cover portion 17, as shown in FIG. 3. The outer open lever 82 is provided with an outer door handle connection portion 83 connecting an outer door handle (not shown) provided outside the vehicle of the door, in a portion protruding to an outer portion from the lock mechanism arranging portion 12. Further, the outer open lever 82 is provided with a link coupling portion 84 coupled to (engaged with) the coupling hole 39 of the like 37, in an end portion arranged within the lock mechanism arranging portion 12. Further, the outer open lever 82 in accordance with the present embodiment is energized in a direction in which the link 37 comes away from the operation receiving portion 36 of the claw 33, by an energizing spring 85.

The drive motor 86 is structured such as to rotate forward and backward the cam member 88, and a worm 87 is attached to an output shaft thereof, as shown in FIG. 1.

The cam member 88 is arranged rotatably in such a manner as to be positioned in a lower portion of the cam receiving portion 66 of the knob lever 61, and an outer peripheral portion thereof is provided with a worm wheel portion 89 engaging with the worm 87. In this cam member 88, a cam groove 90 is provided in a concave manner in an upper surface side opposed to the side of the knob lever 61, in such a manner that a distance from the center is expanded little by little from the center side toward the outer peripheral portion. Further, the cam member 88 is positioned (energized) to a neutral position by an energizing spring (not shown), and is structured such as to activate to lock the link 37 via the knob lever 61 and the lock plate 43 by the rotation of the cam receiving portion 66 so as to move to the center side, and thus to activate to unlock the link 37 via the knob lever 61 and the lock plate 43 by the rotation of the cam receiving portion 66 so as to move to an outer peripheral side.

Next, a description will be given of a motion of the lock mechanism in the door lock apparatus.

Figure 7:
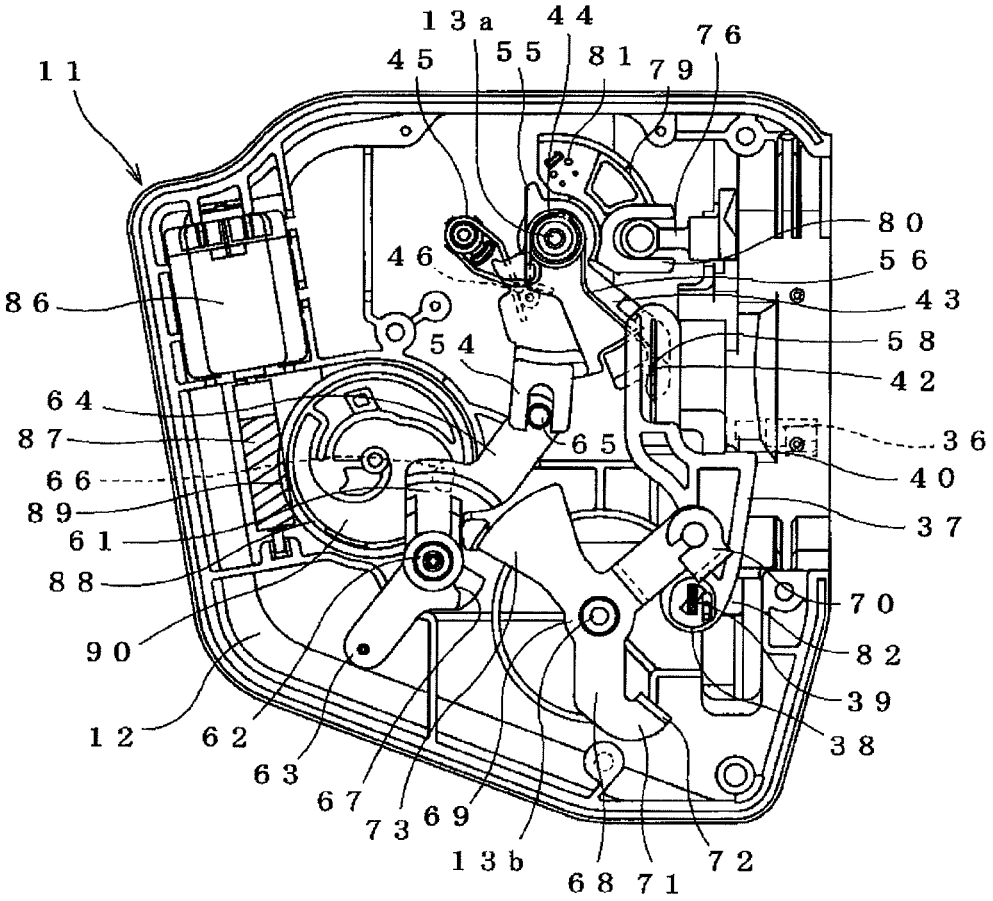
FIG. 7 is a front elevational view showing a door open actuation state of the door lock apparatus.

First of all, in the unlock state shown in FIG. 1, if the outer door handle is operated, the outer open lever 82 is rotated as shown in FIG. 7. Accordingly, the link 37 is moved in the vertical direction along the slide groove 42 extending in the vertical direction, whereby the operation portion 40 of the link 37 engages (comes into contact) with the operation receiving portion 36 of the claw 33. As a result, the movement of the link 37 causes the operation receiving portion 36 to be pressed and allows the claws to be rotated, canceling the engaging state of the striker 1 by the fork 30.

Further, if the inner door handle is operated, the inner open lever 68 is rotated in the counterclockwise direction, thereby coming into contact with the receiving portion 38 of the link 37. Further, in the same manner as mentioned above, the link 37 is moved in the vertical direction and the operation portion 40 is engaged with the operation receiving portion 36 of the claw 33 to rotate the claw 33, canceling the engaging state of the striker 1 by the fork 30.

Figure 8:
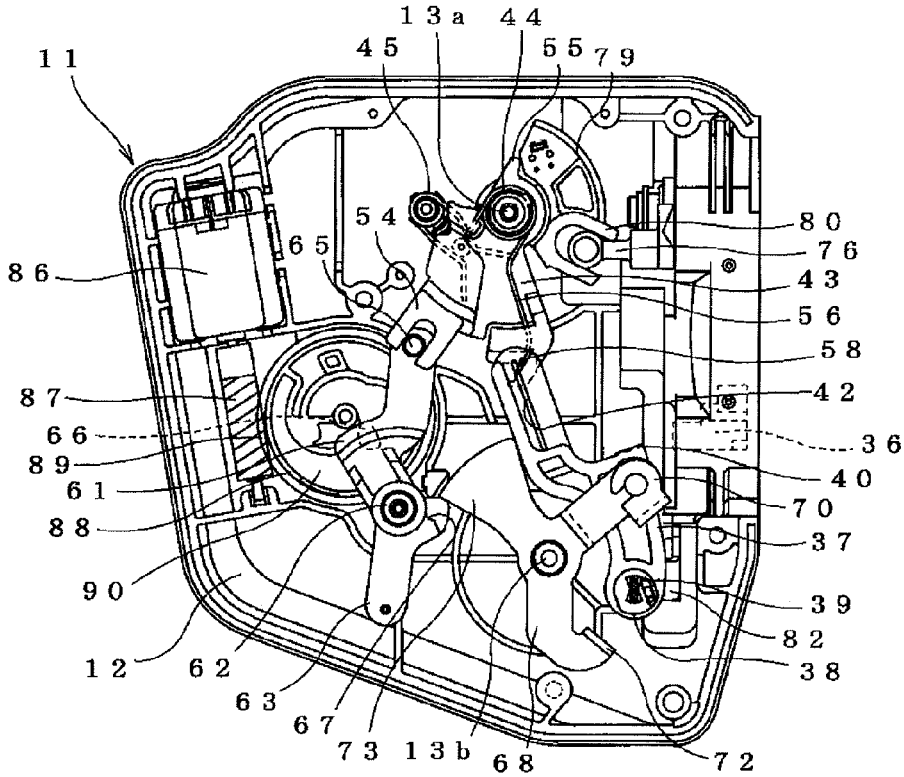
FIG. 8 is a front elevational view showing a lock state of the door lock apparatus.

On the other hand, if the cylinder lock outside the vehicle is operated in this unlock state, the lock plate 43 is rotated in the clockwise direction by the first key lever 74, the key shaft 76 and the second key lever 79, and the link 37 rotates in the counterclockwise direction interlocking with the lock plate 43 to become the lock state as shown in FIG. 8. Further, if the lock knob inside the vehicle is operated to be locked, the knob lever 61 is rotated in the counterclockwise direction, whereby the lock plate 43 is rotated in the clockwise direction, and the link 37 is rotated to the lock position interlocking with the lock plate 43. Further, if the lock operation is carried out by the remote control or the like, the cam member 88 is rotated by the drive motor 86, whereby the knob lever 61 and the lock plate 43 are rotated in the same manner, and the link 37 is rotated to the lock position interlocking with the lock plate 43.

In this lock state, the link 37 comes to a state in which it is moved toward a left upward direction, by the rotation in the clockwise direction of the lock plate 43. Accordingly, if the outer door handle is operated, and the outer open lever 82 is rotated, the receiving portion 38 of the link 37 is pressed upward, and the link 37 is moved diagonally upward along the slide groove 42 which extends obliquely so as to come away from the operation receiving portion 36. Therefore, the operation portion 40 of the link 37 can not engage with the operation receiving portion 36 of the claw 33. As a result, since it is impossible to press the operation receiving portion 36 so as to rotate the claw 33 in the movement of the link 37 in this state, it is impossible to cancel the engaging state of the striker 1 by the fork 30.

On the other hand, in the door lock apparatus in accordance with the present embodiment, since an override function is constructed by the engagement receiving portion 67 provided in the knob lever 61, and the engagement portion 73 provided in the inner open lever 68, it is possible to open the door in a case where the inner door handle is operated in the lock state. In this case, the override function is applied in such a manner that it is provided, for example, only in the door of the driver seat, and the other doors are not provided with the engagement receiving portion 67 of the knob lever 61 and the engagement portion 73 of the inner open lever 68 (are not provided with the override function).

First of all, in the door lock apparatus which is not provided with the override function, if the inner door handle is operated in the lock state, the inner open lever 68 is rotated, and the link 37 is pressed upward, however, the link 37 is moved diagonally upward in the same manner as mentioned above. Accordingly, since the operation portion 40 of the link 37 can not engage with the operation receiving portion 36 of the claw 33, and can not rotate the claw 33, it is impossible to cancel the engaging state of the striker 1 by the fork 30.

Further, in the door lock apparatus in accordance with the present embodiment which is provided with the override function, if the inner door handle is operated in the lock state, the inner open lever 68 is rotated in the counterclockwise direction in a state shown in FIG. 8, whereby the engagement portion 73 of the inner open lever 68 comes into contact (engages) with the engagement receiving portion 67 of the knob lever 61. Further, since the inner open lever 68 is rotated further in this state, the knob lever 61 receives the rotating force, and the knob lever 61 is rotated in the clockwise direction. As a result, the lock plate 43 and the link 37 are rotated to the unlock position. As a result, in the same manner as a case where the inner door handle is operated in the unlock state, it is possible to cancel the lock of the striker 1 by the fork 30 by bringing the operation portion 40 of the link 37 into contact with the operation receiving portion 36 of the claw 33, and activating the claw 33.

Figure 9:
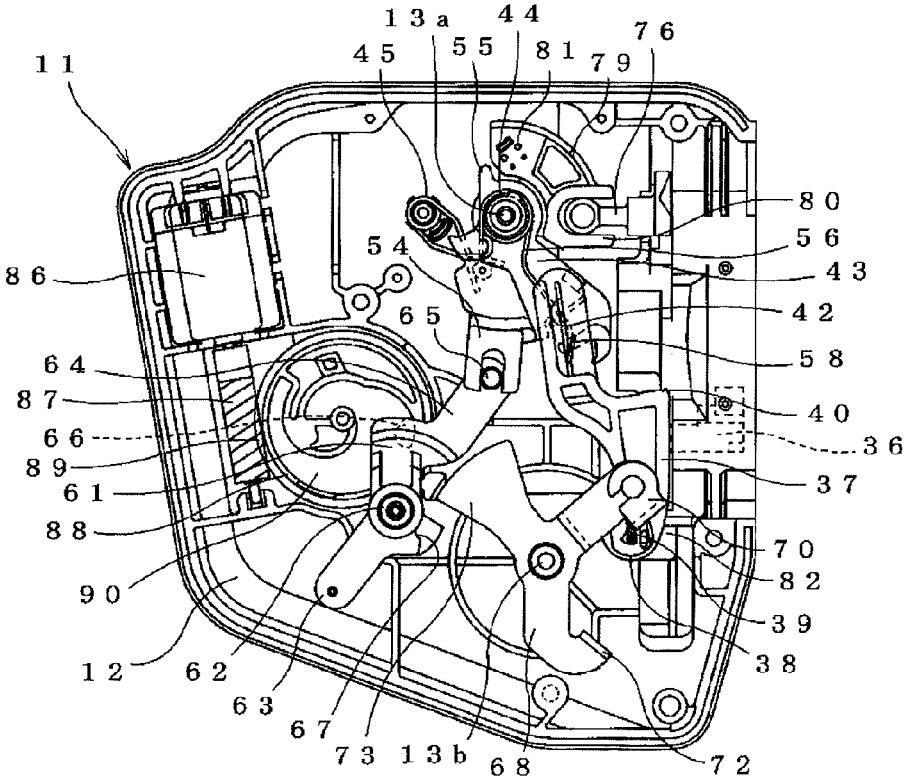
FIG. 9 is a front elevational view showing an unlock actuation state in a door open actuation state of the door lock apparatus.

Further, in the door lock apparatus in accordance with the present embodiment, since the anti-panic mechanism is constructed by engaging and attaching the link 37 and the lock plate 43 by the link energizing spring 56 so as to be relatively movable, it is possible to securely set the unlock state even if the unlocking operation is carried out in a case where the outer door handle is operated in the lock state, as shown in FIG. 9. In this case, in the door lock apparatus which is not provided with the override function, same applies to the unlocking operation in the case where the inner door handle is operated in the lock state.

Figure 10:
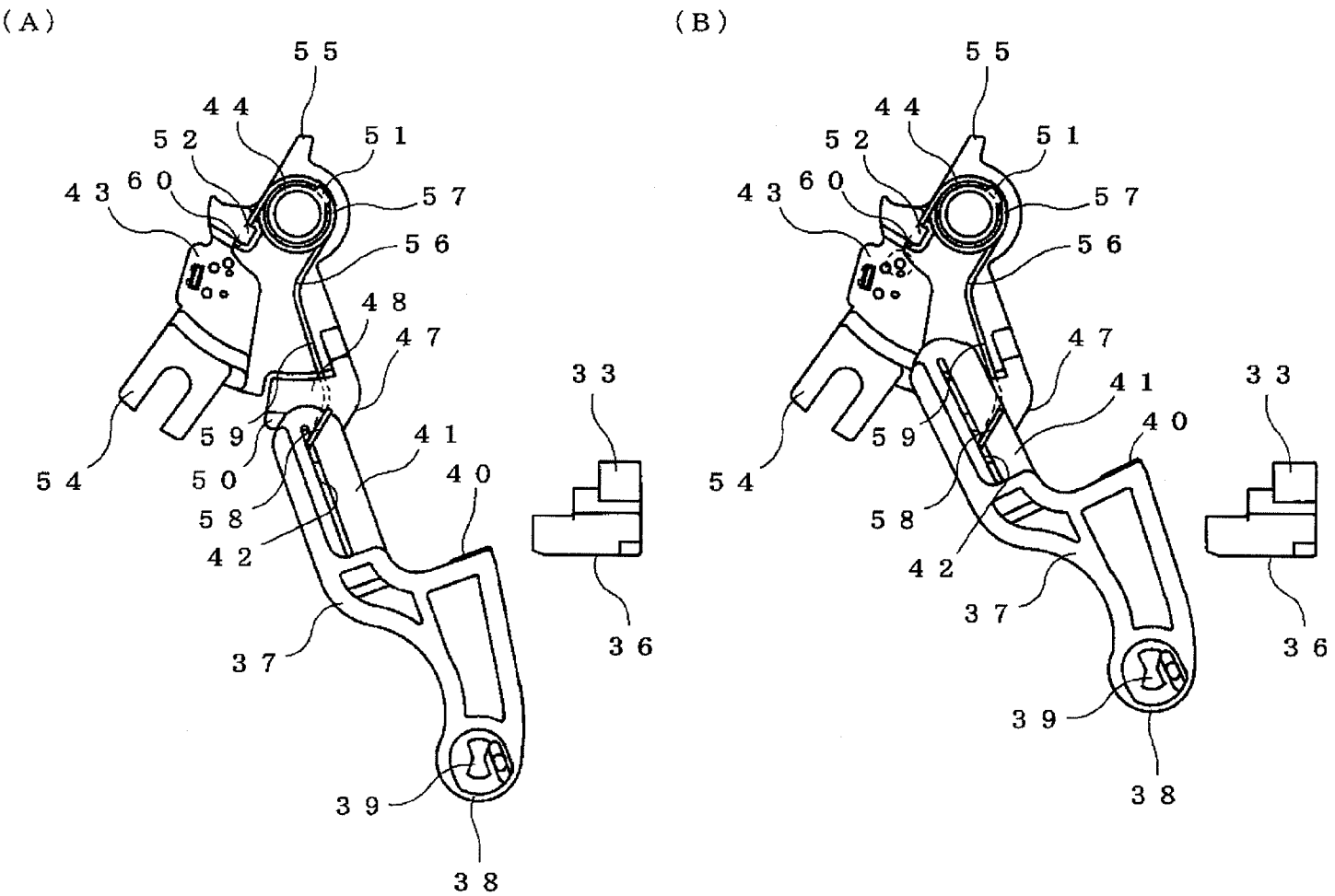
FIGS. 10A and 10B are schematic process views showing an unlock actuation state in a door open actuation state of the door lock apparatus.

Specifically, in the lock state, there is formed a state in which the link 37 is inclined left upward in such a manner that the link 37 comes away from the operation receiving portion 36 of the claw 33, by the rotation of the lock plate 43, as shown in FIG. 10A. If the outer door handle is operated in this state, the link 37 is moved left upward on the basis of the rotation of the outer open lever 82, as shown in FIG. 10B. In this state, the operation portion 40 of the link 37 is positioned above the operation receiving portion 36 of the claw 33.

Accordingly, in this state, if the cylinder lock outside the vehicle is operated to be unlocked, or if the lock knob inside the vehicle is operated to be unlocked, or if it is operated to be unlocked on the basis of the remote control, the lock plate 43 is rotated to the unlock position. As a result, as shown in FIG. 11A, the lower side surface of the operation portion 40 in the link 37 comes into contact with the side surface of the operation receiving portion 36 of the claw 33.

Further, since the link 37 comes into contact with the claw 33 in this state, it can not move further to the unlock position side from this contact position. However, in the present embodiment, the energizing force holding the lock plate 43 to the lock position by the action spring 45 is larger than the energizing force energizing the link 37 to the initial energized position in the unlock position side by the link energizing spring 56. Accordingly, the lock plate 43 relatively moves with respect to the link 37 while elastically contracting the link energizing spring 56, and rotates to the unlock position.

In this state, if the user cancels the opening operation of the outer door handle, the outer open lever 82 is returned to the non-open actuation position before the door opening actuation by the energizing force of the energizing spring 85. Therefore, the link 37 moves downward while coming into slidable contact with the operation receiving portion 36 of the claw 33, while interlocking with the downward movement of the outer open lever 82, as shown in FIG. 11B.

Figure 11:
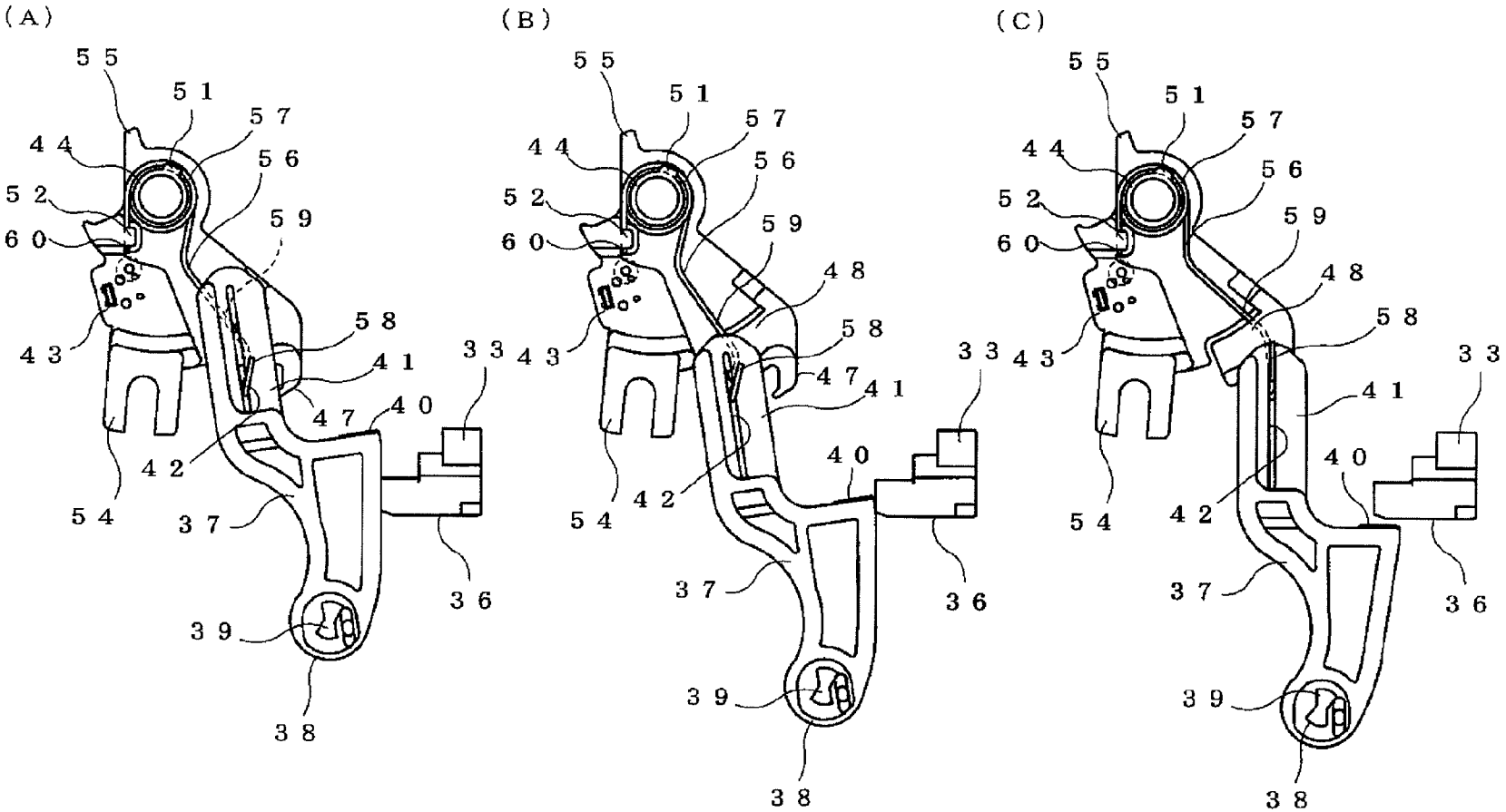
FIGS. 11A, 11B and 11C are schematic process views showing the unlock actuation state in the door open actuation state of the door lock apparatus coming next to FIGS. 10A and 10B.

Further, if the operation portion 40 of the link 37 moves downward to the lower side of the operation receiving portion 36 of the claw 33, as shown in FIG. 11C, the link 37 is rotated to the unlock position by the energizing force of the link energizing spring 56, and is returned to the non-open actuation position before the door opening actuation. Further, this rotation stops at the initial energized position at which the arm portion 59 of the link energizing spring 56 comes into contact with the stopper portion 47 of the lock plate 43.

This state is a normal lock state shown in FIG. 8 in which none of the outer door handle and the inner door handle is operated, and is no different from the unlock state shown in FIG. 1 in which the cylinder lock, the lock knob and the remote control are operated to be unlocked. Accordingly, it is possible to open the door by operating to open the door handles outside the vehicle and inside the vehicle without carrying out the unlocking operation again.

As mentioned above, the door lock apparatus in accordance with the present embodiment can construct the anti-panic mechanism only by engaging and attaching the link 37 with respect to the lock plate 43 in a state of energizing the link 37 toward the unlock position by the link energizing spring 56. In other words, since it is not necessary to construct the lock plate 43 divisionally, and the anti-panic mechanism can be constructed by the simple structure that the link energizing spring 56 is additionally arranged, it is possible to suppress an increase of the manufacturing cost.

Further, in the present embodiment, since the link energizing spring 56 is arranged in the lock plate 43, and the link 37 and the link energizing spring 56 are constructed only by inserting the coupling portion 58 provided in the link energizing spring 56 to the slide groove 42 provided in the link 37, the coupling mechanism can be constructed by the simple structure.

Further, since the lock plate 43 is provided with the stopper portion 47 regulating the link 37 to the initial energized position in the unlock position side via the link energizing spring 56, it is possible to prevent the displacement of the link 37 so as to securely hold the link 37 at the initial position. Further, since the lock plate 43 is provided with the regulating portion 48 regulating the arm portion 59 of the link energizing spring 56, it is possible to securely guide the movement (the displacement) of the link energizing spring 56. Further, even if the link 37 is activated via the open levers 68 and 82 by the operation of the door handle, it is possible to prevent the link 37 from interfering with the link energizing spring 56 by the regulating portion 48. Therefore, it is possible to securely prevent a malfunction of the link 37.

Further, the link energizing spring 56 is structured such as to hold the lock plate 43 by three retention portions including the retention pawl portion 51, the regulating portion 48 and the spring engaging portion 52. Accordingly, it is possible to securely prevent the link energizing spring 56 from coming off from the lock plate 43, and it is possible to improve a workability at a time of assembling.

In this case, the door lock apparatus in accordance with the present invention is not limited to the structure in accordance with the embodiment, but can be modified variously.

For example, in the embodiment mentioned above, the coupling portion 58 is formed by applying the bending work to one end of the link energizing spring 56, however, a coupling portion inserted to the slide groove of the link 37 may be provided as a separate member and be fixed to one end of the link energizing spring 56.

Further, in the embodiment mentioned above, the link energizing spring 56 is arranged with respect to the lock plate 43 by three retention portions including the retention pawl portion 51, the regulating portion 48 and the spring engaging portion 52, however, may be held by at least one retention portion.

Further, in the embodiment mentioned above, the energizing member coupling the lock plate 43 and the link 37 so as to be relatively movable is constructed by the link energizing spring 56 formed by winding the wire rod, however, may be constructed by a band-like leaf spring. In this case, one end of the leaf spring is provided with the coupling portion 58 inserted to the slide groove 42 of the link 37 integrally or separately, and the other end thereof is fixed to the lock plate 43 by a pin or the like.

Further, in the embodiment mentioned above, the link energizing spring 56 corresponding to the energizing member is arranged in the lock plate 43, however, may be arranged with respect to the link 37.

What is claimed is:

1. A door lock apparatus comprising:

a latch mechanism configured to engage a striker mounted on a vehicle body so as to be capable of freely engaging and disengaging from the striker, and having an operation receiving portion configured to cancel engagement of the latch mechanism with the striker;

a link configured to be movable between an unlock position capable of engaging with the operation receiving portion of the latch mechanism, and a lock position incapable of engaging with the operation receiving portion;

a lock plate configured to move the link to the unlock position and the lock position, and having a rotation center; and an open lever configured to interlock with a door handle inside or outside a door of the vehicle, configured to engage with the link so as to activate the link, and configured such that the link engages with the operation receiving portion of the latch mechanism so as to cancel the engagement of the latch mechanism with the striker when the link is at the unlock position, and the link is not capable of engaging the operation receiving portion of the latch mechanism so as to maintain the engagement of the latch mechanism with the striker when the link is at the lock position, wherein the lock plate or the link includes an energizing member comprising:

an annular winding portion supported on an attaching portion disposed on the lock plate coaxially with the rotation center of the lock plate;

an arm portion protruding from one end of the annular winding portion;

a coupling portion in a leading end of the arm portion, the coupling portion being coupled with the link; and an engaging end portion extending from the other end of the annular winding portion, the engaging end portion being engaged with the lock plate, wherein the energizing member couples the lock plate to the link so that the link is movable between the unlock position and the lock position, and is configured to energize the link with respect to the lock plate toward the unlock position, wherein the link includes a slide groove extending along a door opening actuation direction of the link when the link is activated by the open lever, wherein the coupling portion of the energizing member is inserted in the slide groove of the link and configured to be movably and directly coupled with the slide groove of the link, and wherein the lock plate includes a regulating portion configured to enable movement of the arm portion of the energizing member in the directions of the unlock position and the lock position, and configured to regulate a movement of the arm portion in a direction perpendicular to a surface of the lock plate toward the link.

2. The door lock apparatus as claimed in claim 1, wherein the arm portion of the energizing member is held within the lock plate, and wherein the lock plate includes a stopper portion which is constructed by a wall surface protruding from a side edge of the lock plate to a side on which the link is arranged and is configured to regulate the rotation of the link to an initial energized position where the link is in the unlock position.

3. The door lock apparatus as claimed in claim 1, wherein the attaching portion of the lock plate includes a retention portion configured to prevent the winding portion of the energizing member from being disengaged from the attaching portion.

4. The door lock apparatus as claimed in claim 1, wherein the energizing member is a spring.

* * * * *